US007056229B2

(12) United States Patent
Chen

(10) Patent No.: US 7,056,229 B2
(45) Date of Patent: Jun. 6, 2006

(54) WOOD GOLF CLUB HEAD

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 10/791,701

(22) Filed: Mar. 4, 2004

(65) Prior Publication Data

US 2005/0197207 A1 Sep. 8, 2005

(51) Int. Cl.
*A63B 53/04* (2006.01)

(52) U.S. Cl. ..... 473/346

(58) Field of Classification Search ..... 473/345–346, 473/329, 350
See application file for complete search history.

(56) References Cited

U.S. PATENT DOCUMENTS 5,295,689 A * 3/1994 Lundberg ..... 473/346
5,380,010 A * 1/1995 Werner et al. ..... 473/346
5,908,356 A * 6/1999 Nagamoto ..... 473/224
5,941,782 A * 8/1999 Cook ..... 473/346
6,309,311 B1 * 10/2001 Lu ..... 473/332
6,524,197 B1 * 2/2003 Boone ..... 473/324
6,558,271 B1 * 5/2003 Beach et al. ..... 473/327
2003/0104878 A1 * 6/2003 Yabu ..... 473/345
2003/0190975 A1 * 10/2003 Fagot ..... 473/346
2005/0192119 A1 * 9/2005 Beach et al. ..... 473/345

* cited by examiner

*Primary Examiner*—Sebastiano Passaniti
(74) *Attorney, Agent, or Firm*—Browdy & Neimark, PLLC

(57) ABSTRACT

A golf club head includes a housing and a reinforced elastic supporting member. The housing has a front portion on which a face is disposed, a sole portion, a rear portion, a crown portion, a toe portion, a heel portion, a neck, and a chamber inside. The reinforced elastic supporting member has an end bonded to the sole portion or the rear portion of the housing, the other end bonded to the front portion or the crown portion of the housing, and a middle portion suspended in the chamber of the housing.

10 Claims, 3 Drawing Sheets

WOOD GOLF CLUB HEAD

BACKGROUND OF THE INVENTION

1. Field of the Invention

The present invention relates generally to a golf club, and more particularly to a wood golf club head having a reinforced supporting member.

2. Description of the Related Art

When a wood golf club is swung to hit a ball, the ball impacts a face of a head of the golf club and the impact transmits to the head body immediately. The conventional golf club head is provided with reinforced ribs at an interior side of the head or at a back side of the face to increase the strength of the head and the face.

To make a wood golf club driving the ball further, the head of the golf club is designed to have a lower center of gravity. To achieve that character, the head is provided with weight devices at a sole or a rear of the head. The crown of the head also can be made as thinner as possible to lower the center of gravity of the head. For the second solution, the aforesaid reinforced ribs can not be provided at the thinner crown of the head, because that the reinforced ribs conflict with the purpose of lowering the center of gravity. On the other hand, a thinner crown has a weak capacity to sustain the impact while the head hits a ball. After a long time of use, the head with a thinner crown might be damaged at a joint of the crown or the crown might be broken.

SUMMARY OF THE INVENTION

The primary objective of the present invention is to provide a golf club head, which reduces the impact transmitting from a face to a crown while the head hits a ball.

The secondary objective of the present invention is to provide a golf club head, which prevents a joint of the crown from damage.

According to the objectives of the present invention, golf club head comprises a housing and a reinforced elastic supporting member. The housing has a front portion on which a face is disposed, a sole portion, a rear portion, a crown portion, a toe portion, a heel portion, a neck, and a chamber inside. The reinforced elastic supporting member has an end bonded to the sole portion or the rear portion of the housing, the other end bonded to the front portion or the crown portion of the housing, and a middle portion suspended in the chamber of the housing.

DETAILED DESCRIPTION OF THE INVENTION

Figure 1:
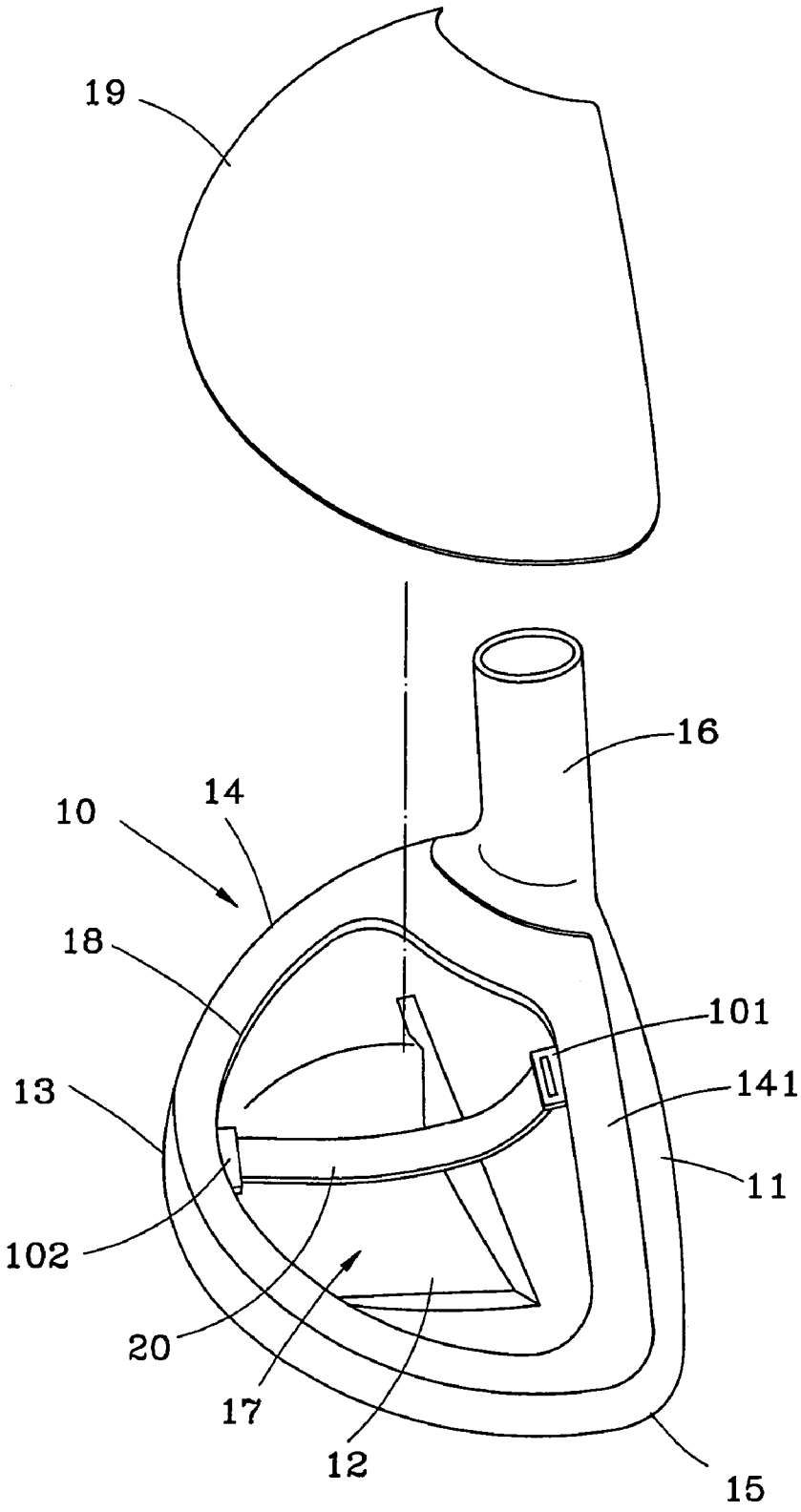
FIG. 1 is an exploded view of a first preferred embodiment of the present invention.
Figure 2:
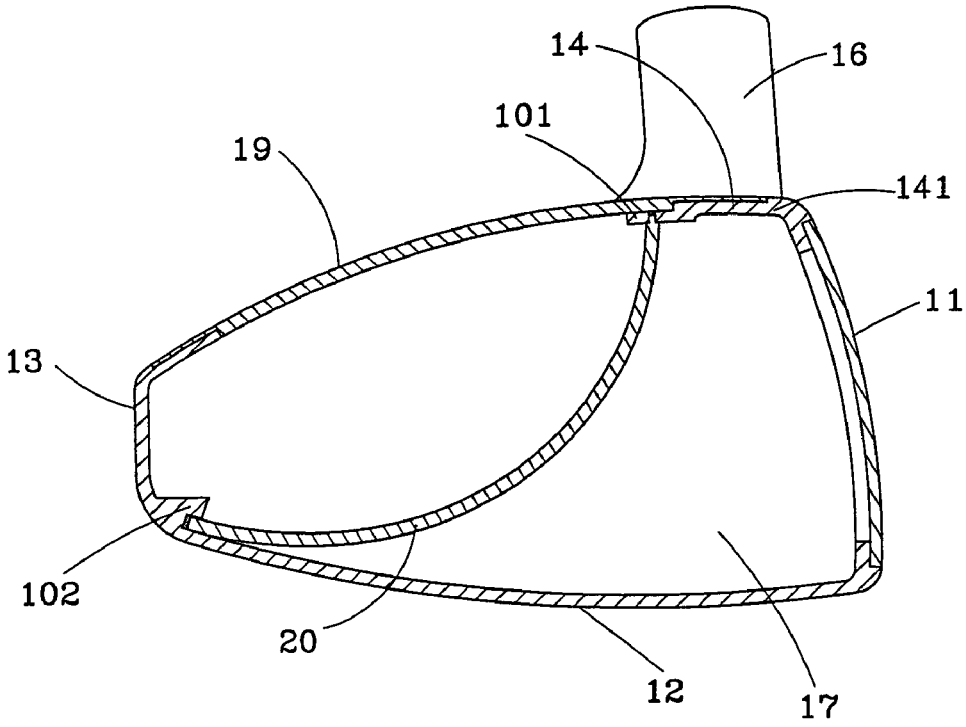
FIG. 2 is a sectional view of the first preferred embodiment of the present invention.

As shown in FIG. 1 to FIG. 2, a golf club head of the first preferred embodiment of the present invention is composed of a housing 10 and an elastic reinforced member 20.

The housing 10 has a front portion on which a face 11 is mounted. The housing 10 further has a sole portion 12, a rear portion 13, a crown portion 14, a toe portion 15, a heel portion and a neck portion 16. The housing 10 has a chamber 17 inside. In this preferred embodiment, the housing 10 has an opening 18 at the crown portion 14. A crown plate 19 is provided to cover the opening 18. The housing has two bonding portions 101 and 102. The bonding portion 101 is disposed at a periphery of the opening 18 on an upper portion 141 of the crown portion 14 adjacent to the front portion on which the face 11 is mounted. The bonding portion 102 is disposed at the sole portion 12 and is adjacent to the rear portion 13.

The elastic reinforced supporting member is designed to be provided in the chamber of the housing and to have an end thereof coupled with the sole portion or the rear portion of the housing and the other end thereof coupled with the crown portion or the front portion of the housing so that the elastic reinforced supporting member has a middle portion thereof suspended in the chamber. The elastic reinforced supporting member is designed to have a hardness greater than HRC 35. It can be made of stainless or other suitable metals. In this preferred embodiment, the elastic reinforced supporting member 20 has two ends inserted and coupled to the bonding portions 101 and 102 respectively by welding.

The elastic reinforced supporting member 20 is elastically deformed while the face 11 hits a ball to absorb the impact, therefore the impact taken by the crown plate 19 is reduced so as to prevent the crown plate 19 bonded to the housing 10 from damage.

Figure 3:
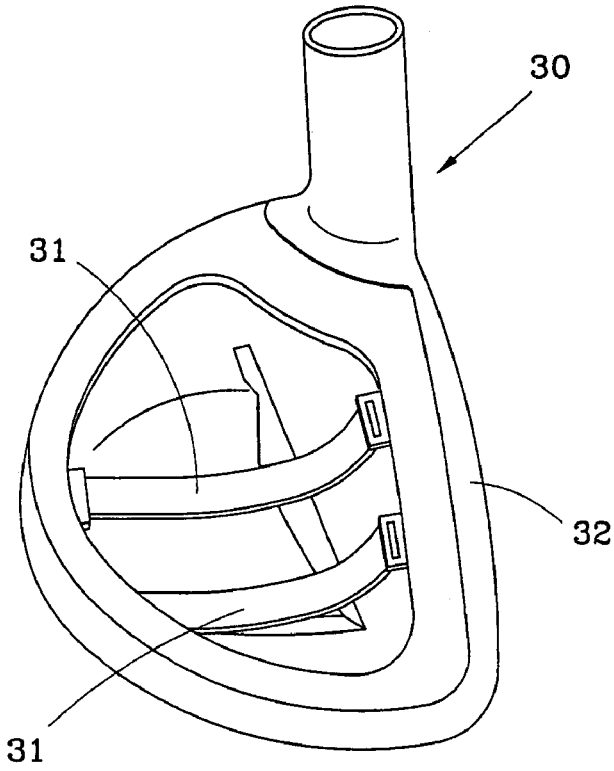
FIG. 3 is a perspective view of a second preferred embodiment of the present invention with the crown plate being removed.

As shown in FIG. 3, a golf club head of the second preferred embodiment of the present invention provides a housing 30 in which two parallel elastic reinforced supporting members 31 are mounted. The elastic reinforced supporting members 31 each have an end bonded to a crown portion of the housing 30 adjacent to a face 32 of the housing 30 and the other end bonded to a sole portion of the housing 30 adjacent to a rear portion of the housing 30. The golf club head of the second preferred embodiment serves a function as same as the golf club head of the first preferred embodiment.

Figure 4:
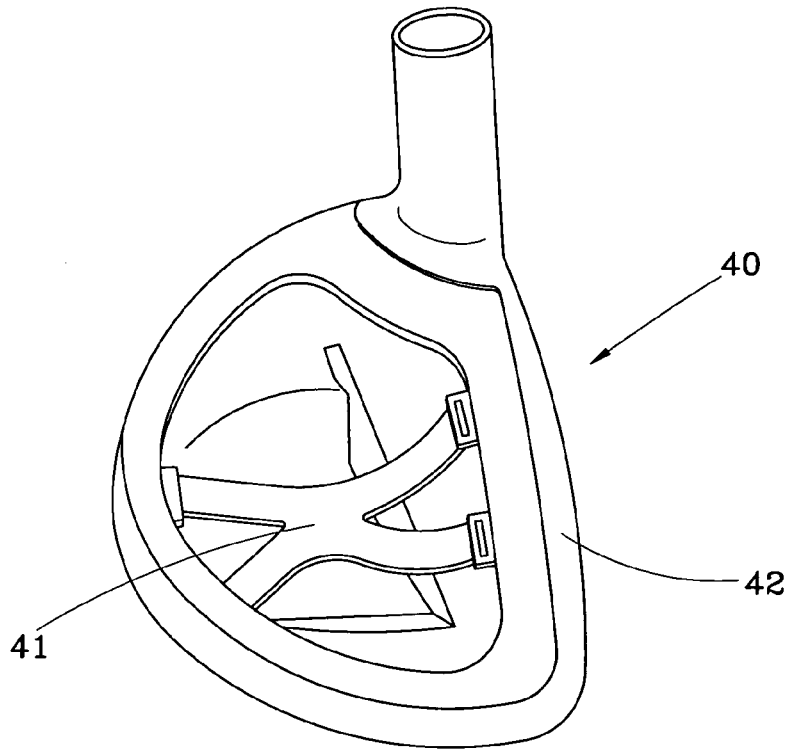
FIG. 4 is a perspective view of a third preferred embodiment of the present invention with the crown plate being removed.

As shown in FIG. 4, a golf club head of the third preferred embodiment of the present invention provides a housing 40 in which an elastic reinforced supporting member 41 is mounted. The elastic reinforced supporting members 41 has a shape of X, wherein the two ends at a side thereof are bonded to a crown portion of the housing 40 adjacent to a face 42 of the housing 40 and the two ends at the other side thereof are bonded to a sole portion of the housing 40 adjacent to a rear portion of the housing. The golf club head of the third preferred embodiment still serves a same function.

Figure 5:
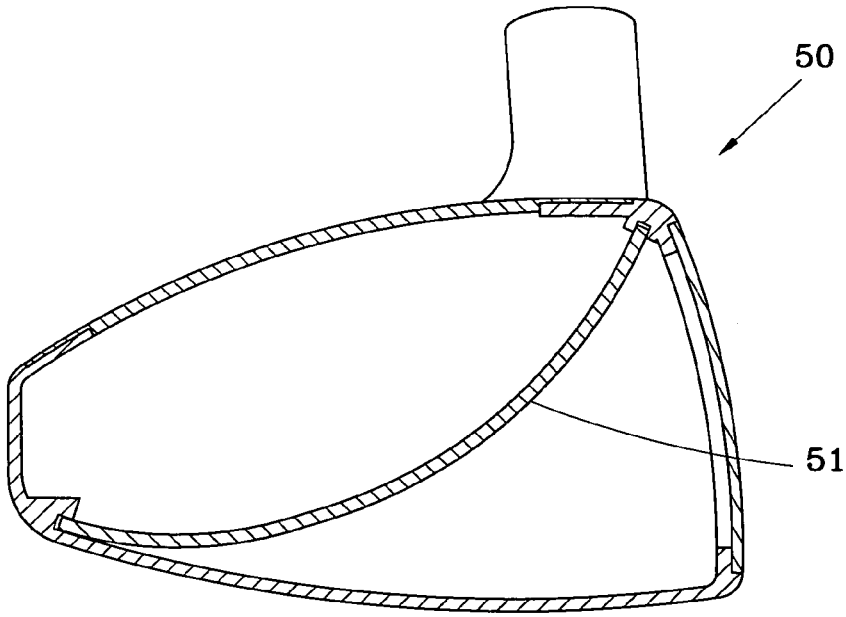
FIG. 5 is a sectional view of a fourth preferred embodiment of the present invention.

As shown in FIG. 5, the golf club head of the fourth preferred embodiment of the present invention provides a housing 50 in which an elastic reinforced supporting member 51 is mounted. The elastic reinforced supporting member 51 is an elongated piece and has an end bonded to a front portion of the housing adjacent to a crown portion of the housing and the other end bonded to a sole portion of the housing 50 adjacent to a rear portion of the housing.

According to the above description, the feature of the present invention is to provide at least one elastic reinforced supporting member in a housing of a golf club head. The elastic reinforced supporting member is elastically deformed while the face hits a ball so that a part of the impact is absorbed by the elastic reinforced supporting member. The strength of a specific portion of the housing can be increased subject to the position where the elastic reinforced supporting member is bonded to the housing, e.g. the face at the front portion and the crown plate at the crown portion. In addition, the elastic reinforced supporting member also vibrates to generate a sound while the face hits a ball. That is another function of the present invention.

What is claimed is:

1. A golf club head, comprising:

a housing having a front portion on which a face is disposed, a sole portion, a rear portion, a crown portion, a toe portion, a heel portion, a neck, a chamber inside and an opening into the chamber;

a reinforced elastic supporting member having an end bonded to the sole portion or the rear portion of the housing, the other end bonded to an upper portion of the crown portion behind the front portion of the housing, and a middle portion suspended in the chamber of the housing;

wherein the end of the supporting member is bonded to the crown portion of the housing adjacent to the face and the other end of the supporting member is bonded to the sole portion of the housing adjacent to the rear portion of the housing.

2. The golf club head as defined in claim 1, wherein the elastic reinforced supporting member is an elongated piece.

3. The golf club head as defined in claim 1, wherein the elastic reinforced supporting member has a hardness greater than HRC 35.

4. The golf club head as defined in claim 1, wherein the elastic reinforced supporting member has a shape of X.

5. The golf club head as defined in claim 1, wherein the housing has a crown plate bonded to the crown portion of the housing to cover the opening, and two bonding portions; wherein one of the bonding portions is disposed at a periphery of the opening on the upper portion of the crown portion, and the other one of the bonding portions is disposed at the sole portion of the housing adjacent to the rear portion of the housing; wherein the ends of the elastic reinforced supporting member are bonded to the bonding portions respectively.

6. The golf club head as defined in claim 5, wherein the elastic reinforced supporting member is bonded to the bonding portions by welding.

7. The golf club head as defined in claim 5, wherein the elastic reinforced supporting member is made of metal.

8. The golf club head as defined in claim 1 comprising at least two said reinforced supporting members.

9. The golf club head as defined in claim 8, wherein said reinforced supporting members are parallel to each other and each of said reinforced supporting members has an end bonded to the upper portion of the crown portion of the housing and the other end bonded to the sole portion of the housing adjacent to the rear portion of the housing.

10. The golf club head as defined in claim 8, wherein each of the elastic reinforce supporting members has a hardness greater than HRC 35.

* * * * *